US006855234B2

(12) United States Patent
D'Astolfo, Jr.

(10) Patent No.: US 6,855,234 B2
(45) Date of Patent: Feb. 15, 2005

(54) SINTER-BONDED DIRECT PIN CONNECTIONS FOR INERT ANODES

(75) Inventor: Leroy E. D'Astolfo, Jr., Lower Burrell, PA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 10/405,761

(22) Filed: Apr. 2, 2003

(65) Prior Publication Data

US 2004/0195092 A1 Oct. 7, 2004

(51) Int. Cl.[7] ..... C25B 11/00

(52) U.S. Cl. ..... 204/280; 204/292; 204/293; 204/291; 204/243.1; 204/247.3; 205/380; 205/384; 205/386; 205/388; 29/745; 29/746

(58) Field of Search ..... 29/745, 746; 204/243.1, 204/247.3, 280, 291, 292, 293; 205/380, 384, 386, 388

(56) References Cited

U.S. PATENT DOCUMENTS 4,374,761 A 2/1983 Ray
4,626,333 A 12/1986 Secrist et al.
5,279,715 A 1/1994 La Camera et al.
6,126,799 A 10/2000 Ray et al.
6,264,810 B1 7/2001 Stol et al.
6,372,119 B1 4/2002 Ray et al.
6,416,649 B1 7/2002 Ray et al.
6,423,195 B1 7/2002 Ray et al.
6,423,204 B1 7/2002 Ray et al.
2001/0035344 A1 11/2001 D'Astolfo, Jr. et al.
2001/0037946 A1 * 11/2001 D'Astolfo et al. ..... 205/389

* cited by examiner

*Primary Examiner*—Bruce F. Bell
(74) *Attorney, Agent, or Firm*—Tracey D. Beiriger; Daniel P. Cillo

(57) ABSTRACT

A sintered electrode assembly is made of an inert electrode (15) containing a sealed metal conductor (20) having a surface feature (30) such as a coating or wrapping which aids in bond formation with the inert electrode (15) at their interface (45), where the metal conductor (20) is directly contacted by and is substantially surrounded by the inert electrode (15) without the use of metal foam or metal powders.

23 Claims, 3 Drawing Sheets

SINTER-BONDED DIRECT PIN CONNECTIONS FOR INERT ANODES

FIELD OF THE INVENTION

This invention relates to low resistance electrical connections between a solid metallic pin conductor and the interior of a ceramic or cermet inert anode used in the production of metal, such as aluminum, by an electrolytic process.

BACKGROUND OF THE INVENTION

A number of metals including aluminum, lead, magnesium, zinc, zirconium, titanium, and silicon can be produced by electrolytic processes. Each of these electrolytic processes employs an electrode in a highly corrosive environment.

One example of an electrolytic process for metal production is the well-known Hall-Heroult process producing aluminum in which alumina dissolved in a molten fluoride bath is electrolyzed at temperatures of about 960° C.–1000° C. As generally practiced today, the process relies upon carbon as an anode to reduce alumina to molten aluminum. The carbon electrode is oxidized to form primarily $CO_2$, which is given off as a gas. Despite the common usage of carbon as an electrode material in practicing the process, there are a number of disadvantages to its use, and so, attempts are being made to replace them with inert (not containing carbon) anode electrodes made of for example a ceramic, metal-ceramic "cermet" or metal containing material.

Ceramic and cermet electrodes are inert, non-consumable and dimensionally stable under cell operating conditions. Replacement of carbon anodes with inert anodes allows a highly productive cell design to be utilized, thereby reducing costs. Significant environmental benefits are achievable because inert electrodes produce essentially no $CO_2$ or fluorocarbon or hydrocarbon emissions. Some examples of inert anode compositions are found in U.S. Pat. Nos. 4,374,761; 5,279,715; 6,126,799; 6,372,119; 6,416,649; 6,423,204; and 6,423,195, all assigned to Alcoa Inc. and herein incorporated by reference.

Although ceramic and cermet electrodes are capable of producing aluminum having an acceptably low impurity content, they are susceptible to cracking during cell start-up when subjected to temperature differentials on the order of about 900° C.–1000° C. In addition, ceramic components of the anode support structure assembly are also subject to damage from thermal shock during cell start-up and from corrosion during cell operation. One example of an inert anode assembly for an aluminum smelting cell is shown in FIG. 3 of U.S. patent application Publication 2001/0035344 A1 (D'Astolfo, Jr. et al.) where cup shaped anodes can be filled with a protective material and then attached to an insulating lid or plate.

Making a low resistance electrical connection between a ceramic or ceramic-metallic electrode and a metallic conductor has always been a challenge. The connection must be maintained with good integrity (low electrical resistance) over a wide range of temperatures and operating conditions. Various attempts have been made with brazing, diffusion bonding, and mechanically connecting with limited success. Examples of sinter threading and electromechanical attachment are shown, for example, in U.S. Pat. Nos. 4,626,333 and 6,264,810 B1 (Secrist et al, and Stol et al. respectively). Also, differential thermal growth between the pin and ceramic or cermet, over the assembly and process temperature range can cause the inert material to crack and/or the electrical connection to increase in resistance; rendering the assembly unfit for continued use.

What is needed is a pin-to inert material interior connection that is simple, not labor intensive to assemble and which will provide a low electrical resistance connection that will not deteriorate over time or cause cracking of the anode. It is a main object of this invention to provide a low electrical resistance connection of the pin conductor and inert anode electrode. It is another object to reduce assembly costs and provide a simplified design and method.

SUMMARY OF THE INVENTION

The above needs are met and objects accomplished by providing, a sintered electrode assembly comprising: an inert electrode containing a sealed metal conductor, the conductor having a surface feature to aid in bond formation, where the conductor is directly contacted by and is substantially surrounded by the inert electrode. No metal foam or metal powder is needed in this invention to achieve good bonding. The invention also resides in a sintered electrode assembly comprising: an inert electrode having a hollow interior with a top portion and interior bottom and side walls; a metal pin conductor having bottom and side surfaces, disposed within the hollow electrode interior and directly contacting the electrode interior walls with the aid of a surface feature on the conductor to aid in bond formation. There is no need for a seal surrounding the metal pin conductor at the top portion of the electrode. This surface feature can be a textural, chemical/mechanical (including mechanical/electrical) surface feature or an internal or external flux feature, and the like and the term "surface feature" is herein meant to include all of the above.

The inert electrode is preferably selected from the group consisting of a ceramic or a cermet inert anode, and the metal pin conductor is selected from the group consisting of nickel, nickel alloy, Inconel, copper, copper alloy, or a corrosion protected steel, preferably having a circular cross-section. The surface feature can be an additive/coating and is preferably a layer selected from the group consisting of nickel, nickel-copper alloy, copper, copper alloy, tin alloy, silver or silver alloy, which has been pre-applied to the metal pin conductor by means of a spray coating, dip coating, paint coating or wrapping. A surface coating of a flux material, pre-applied or which migrates to the interface between the conductor and the anode during sintering is also possible. The anode assembly is useful for an electrolytic cell.

The invention also resides in a method of producing an electrode assembly comprising: (1) providing an inert anode electrode having a hollow interior with a top portion and interior and bottom and side walls; (2) providing a metal pin conductor having a surface feature on the surface of or within the conductor; (3) inserting said conductor into said inert electrode, and (4) sintering to achieve a chemical/mechanical connection, where, during the sintering the surface feature aids bonding.

The preferred metal pin conductor can be inserted at ambient temperatures. The assembly is then sintered and a mechanical-electrical bond is formed as the electrode material shrinks around the metal pin.

The preferred connection design alleviates cracked anodes due to differential thermal growth, provides a stable electrical joint resistance that does not degrade with age, and requires only a coating between the pin and ceramic or cermet. This allows reduced materials and assembly costs and supports simplified automated assembly.

BRIEF DESCRIPTION OF THE DRAWINGS

A full understanding of the invention can be gained from the above and following description when read in conjunction with the accompanying drawings in which.

DETAILED DESCRIPTION OF PREFERRED EMBODIMENTS

Figure 1:
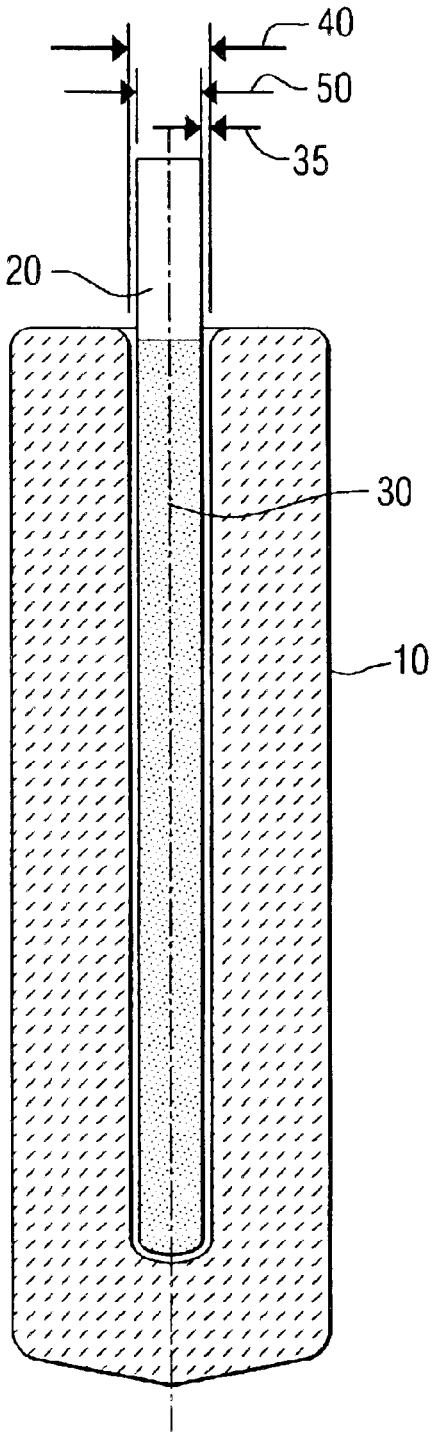
FIG. 1 is a cross-sectional view of one embodiment of an inert anode assembly showing the green anode 10 before sintering, with a metal pin conductor 20, having an external surface additive, preferably a bond-coating 30 on the pin surface, where the pin is, inserted within the anode. There is a gap 35 between the pin outside diameter 50 and the green anode inside diameter. 40.
Figure 2:
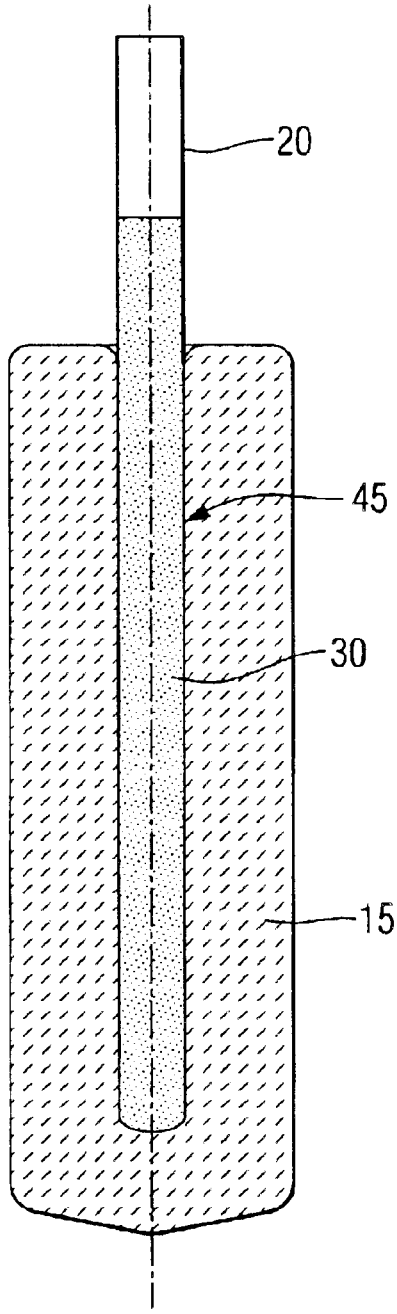
FIG. 2 is a cross-sectional view of the densified inert anode assembly of FIG. 1 after sintering, showing the intimate bond at interface 45 between the conductor and sintered anode.

The metal pin conductor-inert anode connection shown in FIGS. 1–6 can be made in at least three ways: In the first embodiment, shown in FIGS. 1–2, generally, a hole is cast or green machined into the ceramic body 10 during fabrication. Then a specially designed metallic conductor 20 is inserted into the hole, with a calculated clearance. The hole is sized such that during sintering, the ceramic body will shrink around the conductor rod, as shown in FIG. 2, providing a well protected, strong connection at interface 45. The metallic conductor in cases shown in FIGS. 1–6, may be constructed with "surface feature" 30, on the conductor defined as one, or a combination, of a non-smooth surface features, such as longitudinal grooves or screw threads to provide better adherence of the ceramic around the part; or in cases shown in FIGS. 1–6, a metallic alloy material, in the form of a sprayed, dipped or painted coating, wire or ribbon wrapping, applied around the outside of the conductor rod, or internal or external flux material, to provide a bond coating/layer between the metal and cermet or ceramic materials to enhance the electrical connection. The coating is good for all the Figs. shown. The wire or ribbon wrapping is best for FIGS. 3–4. The total thickness of male threads, coating, wire, ribbon, or the like "surface feature" after sintering will range from about 0.1 to 50 mils (0.00025 to 0.127 cm) preferably 10 to 30 mils (0.025 to 0.076 cm). This material is preferably a metal consisting of a copper, nickel, tin, silver, palladium, platinum or an alloy thereof, which melts at the appropriate temperature, usually between about 1050° C. and about 1450° C. during the sintering process, to effect the interface bond.

Figure 3:
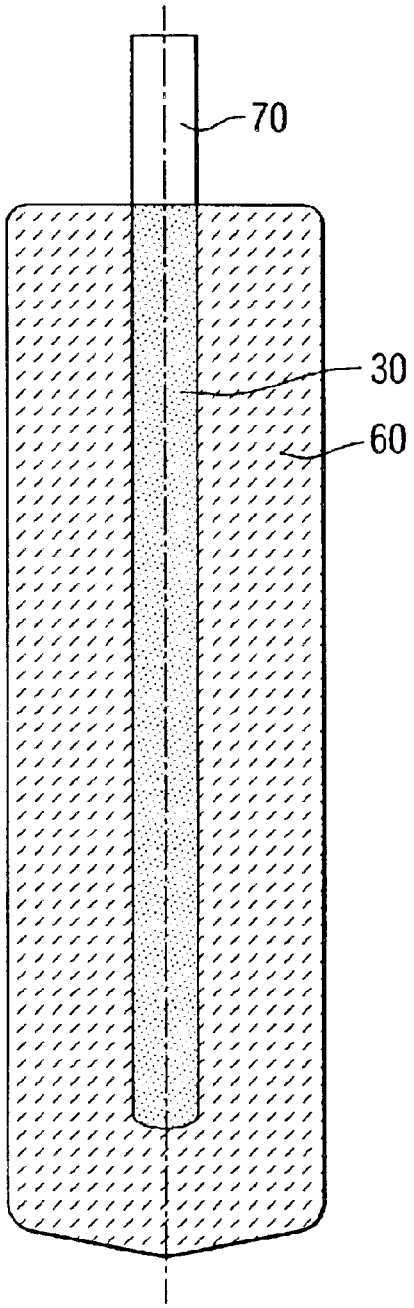
FIG. 3 is a cross-sectional view of another embodiment of an inert anode assembly showing the green anode 60 before sintering, with a bond-coated metal pin conductor 70 pressed into the green anode body 60.
Figure 4:
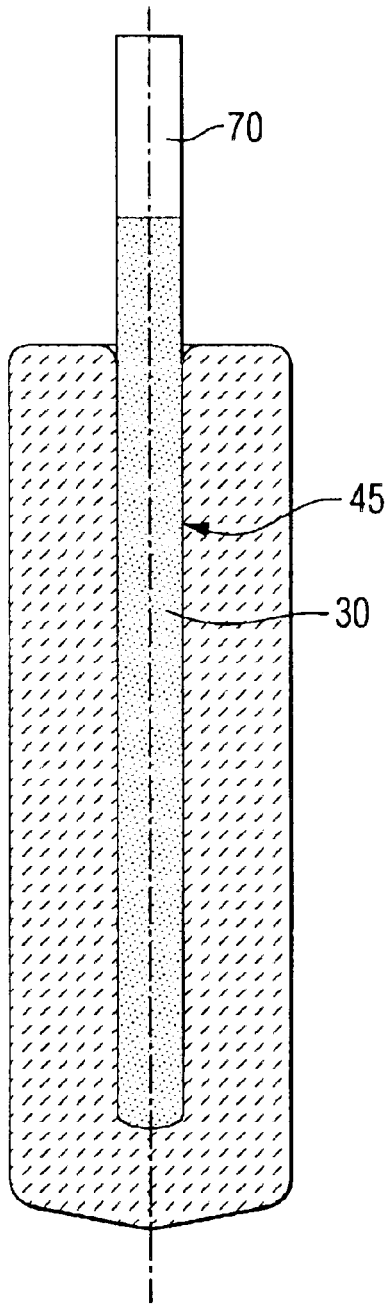
FIG. 4 is a cross-sectional view of the densified inert anode assembly of FIG. 3 after sintering, showing the intimate bond at interface 45 between the conductor and sintered anode.

In the second embodiment, shown in FIGS. 3–4, generally, the coated metallic conductor 70 with surface additive 30 is pressed into the ceramic body 60 before sintering. The whole part is then sintered together as shown in FIG. 4. In this case, there is no clearance between the conductor and ceramic and a strong connection at the interface 45 is still achieved. Similar surface preparation as in the first embodiment is used.

Figure 5:
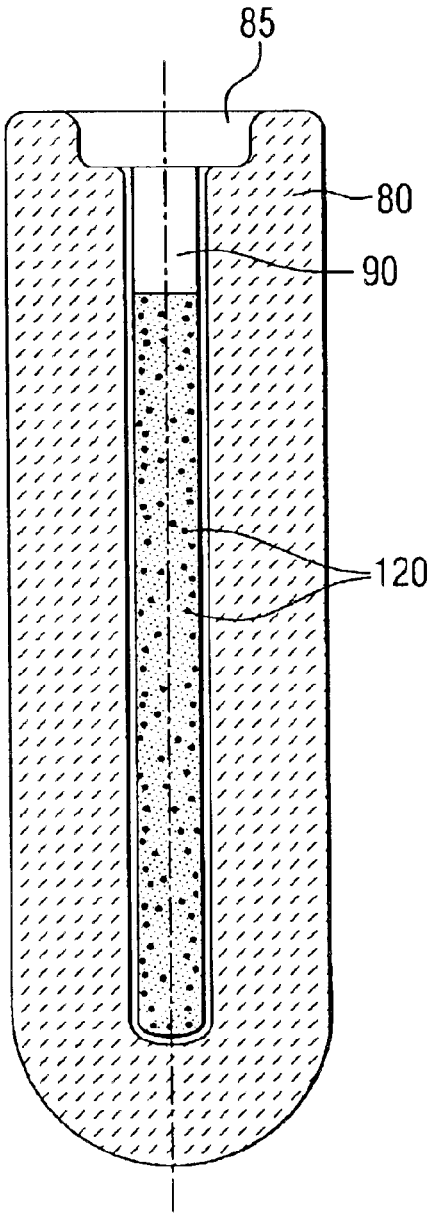
FIG. 5 is a cross-sectional view of another embodiment of an inert anode assembly showing a green anode 80 having a top cavity 85 before sintering, and preferably a bond/flux coated metal pin conductor 90 inserted within the anode 80.
Figure 6:
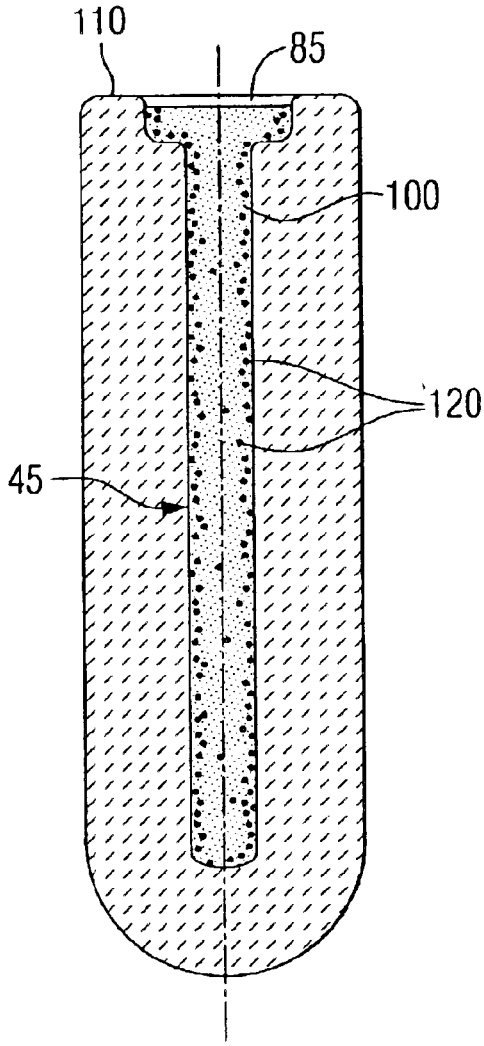
FIG. 6 is a cross-sectional view of the densified inert anode assembly of FIG. 5 after sintering, in which the pin material 100 has melted into the cavity 85 and internal migrational flux material and/or external flux material, shown as dots 120 has helped establish an intimate bond at interface 45 between the conductor and sintered anode.

In the third embodiment, shown in FIGS. 5–6, generally, the ceramic body is prepared in the same way, with an oversized hole. This time, a solid low melting metallic conductor 90, having a melting point of from about 1050° C. to about 1450° C., such as pure copper, nickel, or copper-nickel alloy, is inserted into the hole before sintering. The conductor rod can have a coating of flux 120 on its surface or which is within the rod and will migrate to the surface effective to improve contact with the ceramic of the inert anode and provide a surface additive in the form of flux 120 or the like, and may decrease surface tension and may allow some metal micro permeation/penetration into the ceramic surface pores. This flux type 120 surface additive is shown as dots on the conductor surface or gravitating to the surface in FIGS. 5–6. This may also be accomplished by providing flux interior to the conductor which flux which tends to exit the metal upon melting, forming an initial coating on the ceramic improving metal permeability. Useful flux materials, that is materials which can/may promote flow and fusing into the ceramic can include, for example Sn, Ag and other effective fluxes. The conductor rod melts during sintering, but is contained within the hole, providing a continuous, well conformed joint at the interface 45 between the ceramic body and conductor. The top of the conductor and a metal pool in the cavity 85 at the top of the anode may be machined to accept an extension to bring the current from the source to the anode. In the above embodiments, it may be desirable to design the metal conductor using an outer pipe composed of a stronger material, such as inconel or steel to provide structural integrity and oxidation resistance, with a more electrically conductive material, such as copper filling the inside. In the proposed connection technique, a connection is achieved during the sintering process, and little or no post-machining is required. The connection is also capable of providing both electrical contact and mechanical support.

For convenience, this invention will be described in more detail than above, with reference to an electrode assembly for producing aluminum by an electrolytic process. As used herein, the term "inert anode" refers to a substantially non-consumable, non-carbon anode having satisfactory resistance to corrosion and dimensional stability during the metal production process. This can be a ceramic or cermet (ceramic/metal) material, both of which are well known in the art. Initial porosity of inert anodes powder is reduced to 40 vol. % porosity (60 vol. % of theoretical density) after isostatic or other pressing/molding possibly around a mandrel or the like to form a "green" anode. Upon sintering at about 1150° C. to about 1500° C., preferably 1200° C. to 1400° C. the ceramic powder consolidates to from about 1 vol. % to 10 vol. % porosity (90 vol. % to 99 vol. % of theoretical density).

The metal conductor is usually of a pin/rod design having a circular cross-section as shown in FIG. 1. Here, the conductor rod is made smaller than the hole in the green anode before sintering. The gap is carefully sized such that during sintering, said gap closes and the anode material comes into contact with the metal conductor pin and surface additive 30. The additive bond coat or wrapping on the pin softens or melts at a temperature, achieved during the sintering process, such that it becomes a bonding agent between the metal conductor and anode at interface 45, shown in FIG. 2. The gap 35 between the inert anode and the metal pin conductor is selected to provide complete interference fit after sintering. The anode material does not crack due to the stresses imparted to it from the metal pin because of the compliance and ductility of the anode material at the sintering temperature. The gap 35 between the inert anode and the metal conductor pin can range from nearly zero to 30 mm. Once the connection is achieved at the highest sintering temperatures, somewhere between about 1200° C. to 1500° C., both metal pin and anode shrink together during the cool down process to provide a reduced, highly densified anode, as shown in FIG. 2, and also FIGS. 4, and 6. In all cases the metal pin material is selected to have a higher coefficient of thermal expansion (CTE) than the sintered anode material that is about 2% to 50% higher. The usual coefficient of expansion of inert anode material is, very generally, from about 8 to $30\times10^{-6}$ per degree Celsius (° C.). In this way, very importantly, no stress is added to the anode material during cool down. Some minor disengagement may occur between the pin and anode during cool down, but this has been shown not to affect the quality of the connection. Over about a 50% higher CTE the disengagement may become a problem. In any case, during operation of the anode in electrolysis cells at high temperatures, the gap is substantially closed again.

In the second embodiment shown in FIGS. 3–4, the metal conductor pin 70, with surface additive 30, is directly compression pressed into the green anode 60 before sintering. In this case, there is not a gap between the pin and the anode. The compliance and ductility of the anode material as it sinters completely absorbs the energy of interference with the pin during shrinkage, such that the anode does not crack.

In the third embodiment FIGS. 5–6, the metal pin material 90 is selected to have a melting temperature below the ultimate sintering temperature of the anode 80. In this case, no stress is imparted to the anode material at all during sintering. The dimensions of the initial hole in the anode are sized such that after shrinking is complete, the metal provided completely fills the cavity including part of top cavity 85. The top surface of the metal may have to be machined to a smooth surface 110 in order to attach an extension piece of the desired length. As mentioned previously, a flux material 120 either from the interior of the metal or as an initial coating on the surface of the pin 90 provides a surface additive at the interface 45.

EXAMPLE 1

An electrode assembly was prepared using a hollow inert anode, a metal conductor comprised of Inconel 600 alloy, and a coating on the conductor of a copper-nickel alloy. The anode was isostatically pressed from powder to have a hollow opening of 0.813 inches (2.06 cm) diameter. Anode porosity after pressing was about 40 vol. %. The pin diameter was 0.75 inches (1.9 cm) and the surface additive coating was applied as a flame spray to a thickness of 0.030 inches (0.076 cm) around the pin. The coating composition was 67.8 wt. % copper, 30.6 wt. % nickel with the balance Fe, Mn, Ti and other impurities. The anode was sintered at 1250° C. in an argon atmosphere until a full density, about 1 vol. % to 5 vol. % porosity was achieved. The concurrent shrinkage allowed the sintered anode material to come in contact with the pin and coating and establish a continuous, coherent electrical contact at the interface. The bonding was good enough to serve as a mechanical support. Final anode dimensions were 6 inches (15.24 cm) long by 3 inches (7.62 cm) in diameter, with a hemispherical bottom.

A group of 12 of these anodes were arranged in an assembly consisting of a square array on 4.2 inch (10.6 cm) centers. The anodes were set in an externally heated cell with a graphite crucible and an alumina inner sidewall liner. Bath and aluminum metal were pre-charged as solid materials, and the anode assembly was mounted above the bath. Cell and anodes were preheated simultaneously to an operating temperature of approximately 960° C. Once the bath and metal were molten, the anodes were lowered into the bath at an immersion level of 3.25 inches (8.2 cm), and DC current was applied. Approximately 1086 amperes total, or 90.5 amperes per anode of DC current was applied. The cell was continuously fed with alumina to maintain alumina concentration about 6%. The cell was operated for 334 hours under stable conditions. Average cell voltage was 4.77 volts, and was stable to slowly falling throughout the test, and ranged from 5.3 to 4.5 volts. After the test, the anodes and cell were slowly cooled. Inspection of the anodes afterwards revealed that they were in excellent condition with no cracking and minimal wear.

EXAMPLE 2

A series of 24 anodes were produced and tested in a statistically-designed matrix of experiments. The electrode assemblies were prepared using hollow inert anodes, a metal conductor, and an additive coating on the conductor. The conductor comprised a copper-nickel alloy. The anode was isostatically pressed from powder to have a hollow opening of various diameters. The coating composition was 67.8 wt. % copper, 30.6 wt. % nickel with the balance of Fe, Mn, Ti and other impurities. The anodes were sintered at 1250° C. in an argon atmosphere until a full density was achieved, about 1 vol. % to 5 vol. % porosity. The concurrent shrinkage allowed the sintered anode material to come in contact with the pin and coating and establish a continuous, coherent electrical contact at their interface. The bonding was good enough to serve as a mechanical support. Final anode dimensions were 6 inches long (15.24 cm) by 3 inches (7.62 cm) in diameter, with a hemispherical bottom.

The anodes were isostatically pressed from powder to have a hollow opening. Variables included the gap between the pin and green anode, the pin material, the pin diameter, and the coating thickness. Three levels of gap were produced, such that the final calculated radial interference was 10, 20 and 30 mils (0.025, 0.050 and 0.15 cm respectively). The pin material was varied between Inconel 600 and nickel. The pin diameter was varied between 0.75 and 1.5 inches (1.9 and 3.8 respectively). The coating was a copper-nickel alloy applied by flame spray, and was varied between 5 and 30 mils 0.013 and 0.15 cm respectively).

Each electrode assembly was tested under electrolysis conditions to determine the resulting resistance. The electrode assemblies were tested one at a time. Each was set in an externally heated cell with a graphite crucible and an alumina inner sidewall liner. Bath and aluminum metal were precharged as solid materials and the anode assembly was mounted above the bath. Cell and anodes were preheated simultaneously to an operating temperature of approximately 960° C. Once bath and metal were molten, the anodes were lowered into the bath and DC current was applied. Current was varied from zero to 120 amperes to allow the calculation of resistance, as shown in Table 1 below.

| Test | Radial Interference mils | Pin Material | Pin Diameter inch | Additive Coating thickness mils | Resistance in m'Ω (milli-ohms) |
|---|---|---|---|---|---|
| 1 | 10 | Inconel | 0.75 | 5 | 23.16 |
| 2 | 20 | Inconel | 0.75 | 5 | 20.79 |
| 3 | 30 | Inconel | 0.75 | 5 | 22.52 |
| 4 | 10 | Nickel | 0.75 | 5 | 23.71 |
| 5 | 20 | Nickel | 0.75 | 5 | 20.73 |
| 6 | 30 | Nickel | 0.75 | 5 | 20.11 |
| 7 | 20 | Inconel | 1.5 | 5 | 20.43 |
| 8 | 30 | Inconel | 1.5 | 5 | 20.13 |
| 9 | 10 | Nickel | 1.5 | 5 | 19.82 |
| 10 | 20 | Nickel | 1.5 | 5 | 21.97 |
| 11 | 10 | Inconel | 0.75 | 30 | 22.11 |
| 12 | 20 | Inconel | 0.75 | 30 | 21.57 |
| 13 | 10 | Nickel | 0.75 | 30 | 23.06 |
| 14 | 20 | Nickel | 0.75 | 30 | 19.73 |
| 15 | 30 | Nickel | 0.75 | 30 | 20.13 |
| 16 | 10 | Inconel | 1.5 | 30 | 22.32 |

-continued

| Test | Radial Interference mils | Pin Material | Pin Diameter inch | Additive Coating thickness mils | Resistance in m'Ω (milli-ohms) |
|---|---|---|---|---|---|
| 17 | 20 | Inconel | 1.5 | 30 | 20.57 |
| 18 | 30 | Inconel | 1.5 | 30 | Did not bond well |
| 19 | 10 | Nickel | 1.5 | 30 | 21.89 |
| 20 | 20 | Nickel | 1.5 | 30 | 21.7 |
| 21 | 30 | Nickel | 1.5 | 30 | 21.35 |

The data indicates that there is little difference between the Inconel 600 and the nickel pin materials. Likewise, the diameter of the pin may vary between 0.75 and 1.5 inches (1.9 and 3.8 cm respectively) with little effect. Additive coating thickness can also be varied between 5 and 30 mils (0.013 and 0.15 cm respectively) with no detrimental effect in almost all trials except Test 21 with Inconel, high interference and thick additive coating. The cell resistance was, however, slightly lower when the calculated radial interference was 20 to 30 mils (0.05 cm to 0.15 cm), compared to 10 to 20 mils (0.025 to 0.05 cm).

Having described the presently preferred embodiments, it is to be understood that the invention may be otherwise embodied within the scope of the appended claims.

What is claimed is:

1. A sintered electrode assembly comprising: an inert electrode containing a sealed metal conductor rod, the conductor rod having a surface feature to aid in direct bond formation with the inert electrode, where the conductor rod is directly contacted by and is surrounded by the inert electrode to provide a tight fit between the conductor rod and inert electrode.

2. The electrode assembly of claim 1, wherein the inert anode is selected from the group consisting of ceramic, cermet and metal containing inert anodes, and the tight fit between the conductor rod and inert electrode after sintering is one of an interference fit or direct compression fit, providing continuous coherent contact at their interface.

3. The electrode assembly of claim 1, wherein the metal conductor is selected from the group consisting of nickel, nickel alloy, Inconel, copper, copper alloy, and a corrosion protected steel.

4. The electrode assembly of claim 1, wherein the metal conductor has a circular cross-section and the coefficient of expansion of the conductor is about 2% to 50% higher than the coefficient of expansion of the inert anode.

5. The electrode assembly of claim 1, wherein the surface feature is a chemical/mechanical material comprising an alloy selected from the group consisting of nickel, nickel-copper alloy, copper, copper alloy, tin alloy, silver and silver alloy which has been pre-applied to the metal conductor as a coating or wrapping and melts between about 1050° C. and about 1450° C.

6. The electrode of claim 1, wherein the surface feature is a chemical/mechanical material consisting essentially of a flux material layer, pre-applied or rising to the contact surface of the conductor during sintering.

7. The electrode of claim 1, wherein the surface feature is a non-smooth surface.

8. A sintered electrode assembly comprising: an inert electrode having a hollow interior with a top portion and interior bottom and side walls; a metal pin conductor rod having bottom and side surfaces, disposed within the hollow electrode interior and directly contacting the inert electrode interior walls with the aid of a surface feature on the conductor rod to aid in bond formation with the inert electrode, to provide a tight fit between the conductor rod and inert electrode.

9. The electrode assembly of claim 8, wherein the inert anode is selected from the group consisting of ceramic, cermet and metal containing inert anodes, and the tight fit between the conductor rod and inert electrode after sintering is one of an interference fit or direct compression fit, providing continuous coherent contact at their interface.

10. The electrode assembly of claim 8, wherein the metal conductor is selected from the group consisting of nickel, nickel alloy, Inconel, copper, copper alloy and a corrosion protected steel.

11. The electrode assembly of claim 8, wherein the metal conductor has a circular cross-section.

12. The electrode assembly of claim 8, wherein the surface feature is a chemical/mechanical material comprising an alloy selected from the group consisting of nickel, nickel-copper alloy, copper, copper alloy, tin alloy, silver and silver alloy which has been pre-applied to the metal conductor as a coating or wrapping and melts between about 1050° C. and about 1450° C.

13. The electrode of claim 8, wherein the surface feature is a chemical/mechanical material consisting essentially of a flux material layer, pre-applied or rising to the contact surface of the conductor during sintering.

14. The electrode of claim 8, wherein the surface feature is a non-smooth surface.

15. The sintered electrode assembly of claim 8, wherein a mechanical-electrical bond is formed as the interface of the conductor and inert electrode as the inert electrode material shrinks around the conductor.

16. The sintered electrode assembly of claim 8, wherein the coefficient of expansion of the conductor is from about 2% to 50% times higher than the coefficient of expansion of the inert electrode.

17. A method of producing an electrode assembly comprising the steps:

(1) providing an inert anode electrode having a hollow interior with a top portion and interior bottom and side walls;

(2) providing a metal pin conductor rod having a surface feature on the surface of or within the conductor;

(3) inserting said conductor rod into said inert electrode, and (4) sintering to achieve a chemical/mechanical connection, where, during the sintering the surface feature aids bonding, and where sintering provides a tight fit between the conductor rod and inert electrode, providing continuous coherent contact at the conductor rod-inert electrode interface.

18. The method of claim 17, wherein the surface feature is selected from the group consisting of nickel, nickel-copper alloy, copper, copper alloy, tin alloy, silver and silver alloy, which has been pre-applied to the metal conductor as a coating or wrapping.

19. The method of claim 17, wherein the surface feature is a flux material layer, pre-applied or migrating to the contact surface of the conductor during sintering.

20. The method of claim 17, wherein the surface feature is a non-smooth surface.

21. The method of claim 17, wherein, in step (3) there is a gap between the conductor and electrode, which is closed in step (4).

22. The method of claim 17, wherein, in step (3) there is a tight compression fit between the conductor and electrode, which remains after step (4).

23. The method of claim 17, wherein the conductor contains on its body or on its surface a flux material and has a melting temperature lower than the sintering temperature and melts during step (4) such that the flux material promotes metal flow and fusing of the metal to the inert anode material.

* * * * *